US010221849B2

(12) United States Patent
Roycroft et al.

(10) Patent No.: US 10,221,849 B2
(45) Date of Patent: Mar. 5, 2019

(54) FORGED FLANGE LUBRICATOR

(71) Applicant: Patriot Artificial Lift, LLC, Houston, TX (US)

(72) Inventors: Robert Roycroft, Houston, TX (US); Darrell Wayne Mitchum, Oakhurst, TX (US)

(73) Assignee: Patriot Artificial Lift, LLC, Houston, TX (US)

( * ) Notice: Subject to any disclaimer, the term of this patent is extended or adjusted under 35 U.S.C. 154(b) by 323 days.

(21) Appl. No.: 15/010,614

(22) Filed: Jan. 29, 2016

(65) Prior Publication Data

US 2016/0341195 A1 Nov. 24, 2016

Related U.S. Application Data

(60) Provisional application No. 62/163,191, filed on May 18, 2015.

(51) Int. Cl.

| | |
|---|---|
| ***E21B 43/12*** | (2006.01) |
| ***F04B 47/12*** | (2006.01) |
| ***F04B 53/18*** | (2006.01) |
| ***E21B 33/068*** | (2006.01) |

(52) U.S. Cl.

CPC ..... *F04B 53/18* (2013.01); *E21B 33/068* (2013.01); *E21B 43/121* (2013.01); *F04B 47/12* (2013.01)

(58) Field of Classification Search

CPC ..... F04B 47/12; F04B 53/18; E21B 33/068; E21B 43/121

See application file for complete search history.

(56) References Cited

U.S. PATENT DOCUMENTS

| | | | | | |
|---|---|---|---|---|---|
| 1,415,788 | A | * | 5/1922 | Burlin | E21B 33/03 166/88.1 |
| 1,932,992 | A | * | 10/1933 | Sherman | F04B 47/12 417/58 |
| 2,215,751 | A | * | 9/1940 | Coleman | B60G 3/01 267/191 |
| 2,312,476 | A | | 3/1943 | Penick et al. | |
| 2,676,547 | A | * | 4/1954 | Knox | F04B 47/12 166/133 |
| 2,956,797 | A | * | 10/1960 | Polhemus | F16F 9/049 267/64.24 |
| 3,127,197 | A | * | 3/1964 | Kretzschmar | E21B 33/047 166/89.3 |
| 4,629,004 | A | * | 12/1986 | Griffin | F04B 47/12 166/170 |

(Continued)

FOREIGN PATENT DOCUMENTS

| | | | | |
|---|---|---|---|---|
| CA | 2635993 | A1 | 12/2009 | |
| CA | 2791489 | A1 | 12/2012 | |
| GB | 1458906 | A * | 12/1976 | B60G 11/20 |

*Primary Examiner* — James G Sayre

(74) *Attorney, Agent, or Firm* — Park, Vaughan, Fleming & Dowler LLP

(57) ABSTRACT

Embodiments of a forged flange lubricator and systems incorporating the same are described. In an embodiment, the forged flange lubricator may include a main body configured to receive fluid raised by a plunger lift assembly from a well. Additionally, the lubricator may include a port in the main body configured to conduct fluid as it is received by the main body, wherein the main body and the port are a unitary structure devoid of applied junctions.

16 Claims, 8 Drawing Sheets

(56) References Cited

U.S. PATENT DOCUMENTS

| | | | | |
|---|---|---|---|---|
| 5,253,713 | A * | 10/1993 | Gregg | E21B 33/068 166/372 |
| 6,467,541 | B1 * | 10/2002 | Wells | E21B 43/121 166/153 |
| 6,478,087 | B2 | 11/2002 | Allen | |
| 7,040,401 | B1 * | 5/2006 | McCannon | E21B 33/068 166/250.15 |
| 7,819,189 | B1 * | 10/2010 | Cosby | E21B 47/09 166/250.01 |
| 2008/0029721 | A1 * | 2/2008 | Miyahara | A61M 39/287 251/6 |
| 2009/0308691 | A1 * | 12/2009 | Commins | E21B 33/068 184/14 |
| 2013/0020091 | A1 * | 1/2013 | Maerz | E21B 43/121 166/379 |
| 2014/0090830 | A1 * | 4/2014 | Maerz | E21B 33/068 166/105 |
| 2015/0136389 | A1 * | 5/2015 | Bergman | E21B 43/121 166/250.15 |
| 2017/0122084 | A1 * | 5/2017 | Brewer | E21B 43/121 |

* cited by examiner

FORGED FLANGE LUBRICATOR

RELATED CASE

This application claims priority under 35 U.S.C. § 119 to U.S. Provisional Application No. 62/163,191, entitled "One-Piece, High-Pressure Lubricator," by Robert G. Roycroft and Darrell W. Mitchum, filed 18 May 2015, the contents of which are herein incorporated by reference in their entirety.

FIELD

This disclosure relates generally to oil and gas well systems, and more specifically, to a forged flange lubricator.

BACKGROUND

It is well known that production from oil and gas wells can suffer due to the build-up of fluids at the bottom of the well. See e.g., U.S. Pat. No. 6,148,923, which is incorporated herein by reference. Various methods and devices have been developed to remove those fluids so as to improve the well's productivity.

One such device is known as a plunger, of which there are many variants known to those skilled in the art. For example, an auto-cycling plunger operates as follows: (1) it is dropped into the well (at the well's surface), (2) it free-falls down the well until it stops upon impact with the bottom of the well, and (3) it thereafter is caused (by pressure in the well) to travel back toward the surface of the well, pushing a "load" of liquid above it for removal at the well's surface by a lubricator assembly. The plunger then is allowed to repeat that cycle, thereby ultimately removing enough fluid from the well to improve its production.

A number of problems have arisen from the use of prior art plungers. For example, due to the typically great distance between the surface and bottom of a well, and high pressures within the well system, the plunger travels at a great rate of speed when it is received by the lubricator. Impacts between the plunger and the lubricator can be violent; they often are so violent that damage occurs (either immediately or over time due to repeated use) to lubricator. As another example, the repeated cycling of the plunger causes at least certain of its parts eventually to wear out.

For example, a prior art lubricator includes a main body configured to receive the plunger. The main body may include a spring or catcher assembly for dampening the impact between the lubricator and the plunger. Fluids raised by the plunger may be ejected from the main body through one or more ports. In prior lubricator assemblies, the ports are pipes, flanges, threaded connectors, or the like that are welded over a hole in the main body.

The lubricator experiences high fluid pressures when the fluids are compressed at the lubricator by the plunger because of the violent impacts between the plunger and the lubricator assembly. Further, vibrations are experienced by the lubricator and connected assemblies each time the plunger impacts the lubricator. Consequently, wear and tear during normal operation of the plunger lift assembly can be experienced by all components of the system, and in particular by the lubricator. A common failure point of the lubricator component is the junctions or welds between the ports and the main body. The high pressures may cause leaks at the junctions, or vibration may degrade the welds over time, particularly when heavy pipe or other components are attached to the ports.

SUMMARY

Embodiments of a forged flange lubricator and systems incorporating the same are described. In an embodiment, the forged flange lubricator may include a main body configured to receive fluid raised by a plunger lift assembly from a well. Additionally, the lubricator may include a port in the main body configured to conduct fluid as it is received by the main body, wherein the main body and the port are a unitary structure devoid of applied junctions.

A system including a forged flange lubricator is also described. In an embodiment, the system includes a well assembly comprising a well bottom, a wellhead, and a well pipe coupling the wellhead to the well bottom, a plunger lift assembly configured to lift fluid from the well bottom to the wellhead, a bumper assembly disposed proximate to the well bottom and configure to catch the plunger lift assembly before reaching the well bottom, and a lubricator disposed proximate to the wellhead. In an embodiment, the lubricator includes a main body configured to receive fluid raised by the plunger lift assembly from the well assembly, and a port in the main body configured to conduct fluid as it is received by the main body, wherein the main body and the port are a unitary structure devoid of applied junctions.

DETAILED DESCRIPTION

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The present embodiments include a well system for oil and/or gas production. In an embodiment, the well system includes a well assembly comprising a well bottom, a wellhead, and a well pipe coupling the wellhead to the well bottom. The system may also include a plunger lift assembly configured to lift fluid from the well bottom to the wellhead. In an embodiment, the system includes a bumper assembly disposed proximate to the well bottom and configure to catch the plunger lift assembly before reaching the well bottom. The system may also include a lubricator disposed proximate to the wellhead.

In an embodiment, the lubricator may include a main body configured to receive fluid raised by the plunger lift assembly from the well assembly, and a port in the main body configured to conduct fluid as it is received by the main body. The main body and the port are a unitary structure devoid of applied junctions. As used herein, the term "unitary structure" means a single piece or part. As used herein the term "applied junction" means union of separate components applied together by a secondary process. For example, a port applied to a main body by an applied junction would include a port, coupler, or connector welded, bolted, adhesively applied, or otherwise applied to the main body in a step that is secondary to initial formation of the main body. For example, a lubricator structure that is forged with integrated ports is devoid of applied junctions in some embodiments.

Beneficially, the embodiments described herein allow for a non-threaded, zero weld lubricator solution. Upon testing of the described lubricator, an embodiment was tested up to 15K psi, rated for pressures up to 10K psi, and did not include a single applied junction, such as a weld. A further benefit of the described embodiments is that the secondary steps of joining the ports to the main body may be eliminated, or at least significantly reduced. One of ordinary skill will recognize additional benefits and advantages of the described embodiments.

Figure 1:
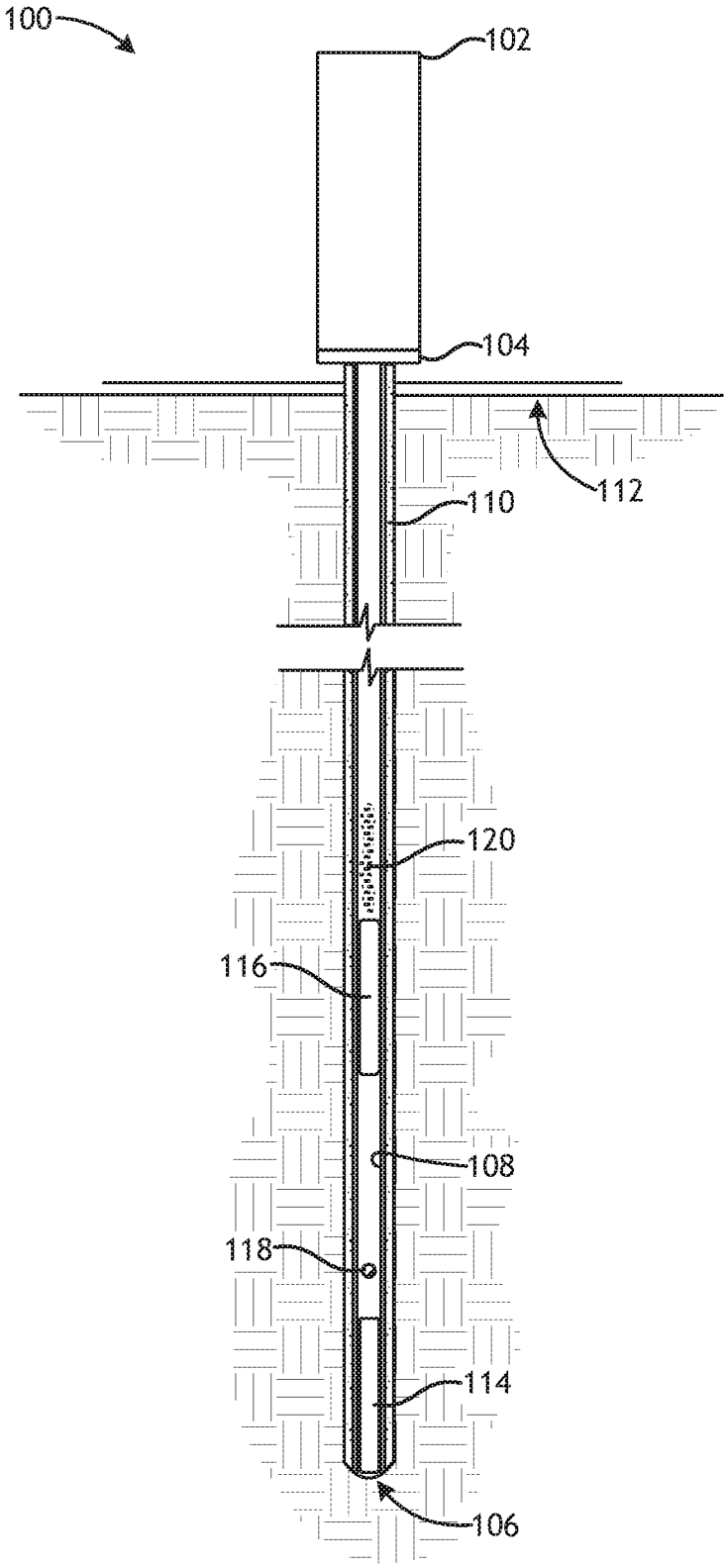
FIG. 1 is a schematic diagram illustrating one embodiment of a system having a forged flange lubricator.

FIG. 1 is a schematic diagram illustrating one embodiment of a system 100 having a forged flange lubricator 102. In the depicted embodiment, the system 100 includes a well assembly having a well bottom 106 and a wellhead 104 coupled together by well pipe 108. The well pipe 108 may be inserted into a hole formed by the well casing 110. Well casings 110 may be formed in the ground 112 with concrete or other structurally adequate materials. The well pipe 108 and well casing 110 may be of indeterminate length. In some embodiments, the well may be a vertical well as shown. In other embodiments, the well may be a horizontal well configuration, or a hybrid well configuration, as is recognized by one of ordinary skill in the art.

The system 100 may include a bumper assembly 114 proximate to the well bottom 106. In an embodiment, the plunger 116 may be configured to lift fluid 120 from the well bottom 106 to the wellhead 104. The fluid 120 is received by the lubricator 102 and expelled through one or more ports to peripheral components (not shown). In an embodiment, the plunger 116 may engage with a stopper, such as the ball 118. In some embodiments, the ball 118 may be a steel sphere configured to be received by a portion of the plunger 116. The stopper may restrict flow of fluid through or around the plunger 116, thereby causing the plunger to rise to the lubricator 102. The lubricator 102 may cause the stopper 118 to be released, thereby allowing passage of fluids through or around the plunger 116, and causing the plunger 116 to fall back to the bumper 114. The bumper 114 may dampen the impact forces when the plunger 116 approaches the bottom of the well 106. The stopper 118 may be received by the plunger 116 again, and the process may repeat, thereby cyclically lifting fluid 120 to be expelled by the lubricator 102.

Figure 2:
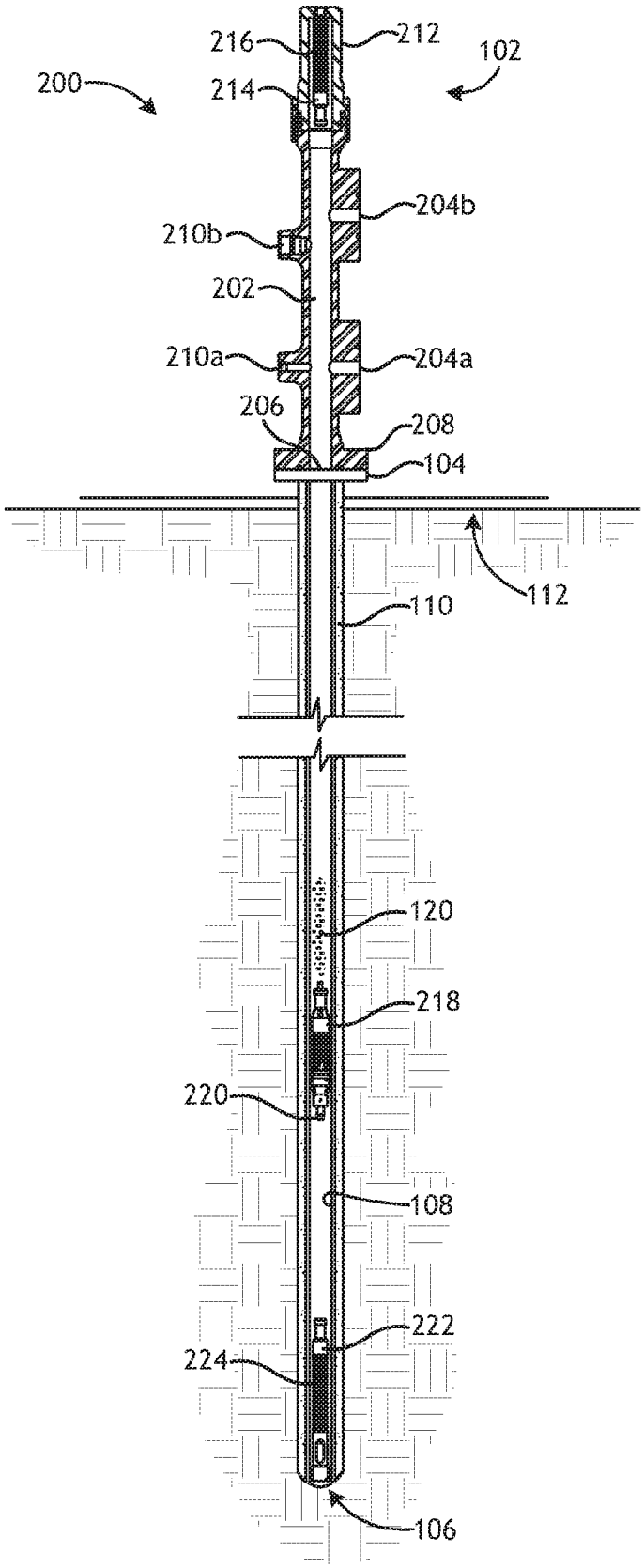
FIG. 2 is a schematic diagram illustrating one embodiment of a system having a forged flange lubricator.

FIG. 2 is a schematic diagram illustrating one embodiment of a system 200 having a forged flange lubricator 102. As in the embodiment of FIG. 1, the well may include a well bottom 106 and a wellhead 104 separated by a well pipe 108 and a well casing 110 formed in the ground 112. In the depicted embodiment, the lubricator 102 may include a main body 202. The lubricator 102 may also include a plurality of fluid conduit ports 204*a-b*, and plurality of instrumentation port(s) 210*a*. In addition, the lubricator 102 may include a catcher port 210*b* configured to receive a catch assembly (not shown) for catching and releasing the plunger 218 within the lubricator 102. Additionally, the lubricator 102 may include an inlet port 206 having an inlet flange 208 for coupling the lubricator 102 to the wellhead 104.

In an embodiment, the system may include a caged dart plunger 218 having an internally captured dart 220 as a sealing member, which replaces the ball 118 of FIG. 1. An example of a caged dart plunger 218 is described in greater detail in U.S. patent application Ser. No. 14/570,269 entitled "Improved Bypass Dart and Assembly," filed on Dec. 15, 2014, which is incorporated herein in its entirety. Although the caged dart plunger is one embodiment of a plunger assembly that may be suitable for use according to the present embodiments, one of ordinary skill will recognize alternative embodiments which may be equally suitable, including for example, the ball stopper embodiment describe in FIG. 1.

In an embodiment, the progressive rate bumper 222 may include a progressive rate spring 224. One example of a progressive rate bumper 222 which may be suitable for use with the present embodiments is described in U.S. patent application Ser. No. 14/333,058 entitled "Bumper Assembly Having Progressive Rate Spring," filed on Jul. 16, 2014, which is incorporated herein by reference in its entirety. Although the progressive rate bumper 224 is one embodiment of a bumper 114 that may be included with the present embodiments, one of ordinary skill will recognize alternative embodiments of bumpers 114 which may be equally suitable.

In the embodiment, of FIG. 2, the lubricator 102 may include a spring assembly 214, which may further include a catch spring 216 disposed in a spring housing 212. In an embodiment, the catch spring 216 may also be a progressive rate spring, as described in relation to the bumper spring assembly. Alternatively, the catch spring 216 may be a common constant rate spring. One of ordinary skill will recognize various embodiments of a spring/catch assembly which may be used in conjunction with the present embodiments of the lubricator 102. The spring assembly 214 may work in conjunction with the catch assembly (not shown) which is received by a catch port 210*b*. The catch assembly may include a flange or lever for locking the plunger 218 in place, or for releasing the plunger 218 back into the well.

Figure 3:
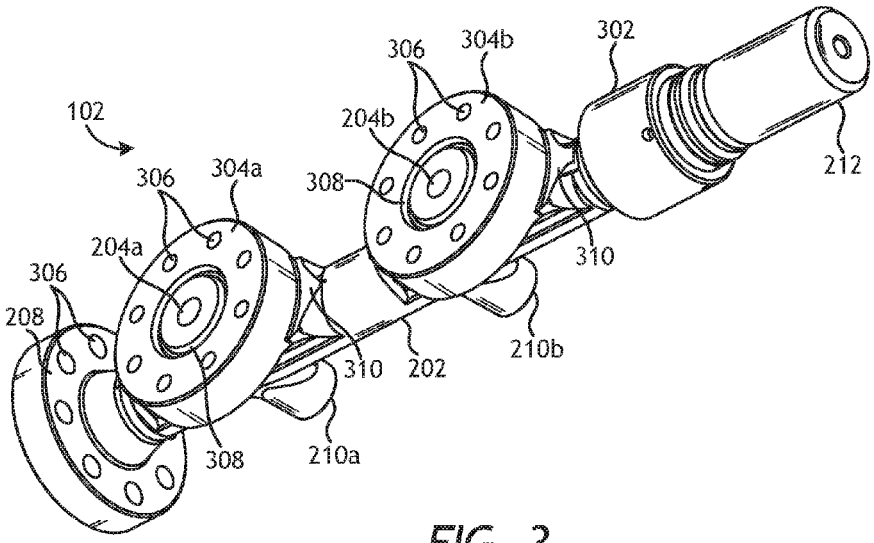
FIG. 3 is a perspective view diagram illustrating one embodiment of a forged flange lubricator.

FIG. 3 is a perspective view diagram illustrating one embodiment of a forged flange lubricator 102. In an embodiment, the lubricator 102 may include a main body 202 configured to receive fluid 120 raised by the plunger 116 lift assembly from a well bottom 106. Additionally, the lubricator 102 may include a plurality of ports 204*a-b*[, 210 and 211] in the main body 202 configured to conduct fluid as it is received by the main body 202. In particular, the main body 202 and the ports 204*a-b*, 210*a* and 210*b* are a unitary structure devoid of applied junctions. For example, the ports 204*a-b* and/or 210*a* and 210*b* may be forged together with the main body 202, thereby eliminating the need for welds, fixtures, etc. between the main body 202 and the ports 204*a-b*, 210*a* and 210*b*.

While some ports may be used to conduct fluid from the lubricator, such as 204*b*, for example, other ports may be used for instrument sensors, such as 210*a*, for catch assembly components such as catch port 210*b*, or for fluid injection such as 204*a*. One of ordinary skill will recognize a variety of embodiments which may be suitable for use according to the present embodiments. For example, an additional port may include the inlet with inlet flange 208 or a port for the spring assembly 214. In the embodiment of FIGS. 3-9, the ports 204*a* and 204*b* may include a flange 304*a* and 304*b* respectively for attaching one or more peripheral components. Additionally, the flanges 304*a-b*may each include one or more fixation points 306 which may be used to affix the flange to a peripheral device. For example, the fixation points 306 may include holes or slots for receiving screws, bolts, ties, etc. Similarly, flange 208 may also include one or more fixation points 306 for attaching the lubricator 102 to the wellhead 104.

In an embodiment, the flanges 304*a-b* may include sealing member receivers 308 configured to receive a sealing member to form a seal between the flange 304*a-b* and the peripheral component. For example, a sealing member (not shown) may include an O-ring, a gasket, a sealing compound, grease, or the like. One of ordinary skill will recognize a variety of sealing members that may be suitable for use according to the present embodiments.

In an embodiment, the ports 204*a-b* may include a support structure 310 formed to provide structural support around the area of the ports 204*a-b*. In an embodiment, the support structure 310 may be a region of material disposed around the ports 204*a-b* that is thicker than the side wall of the remainder of the main body 202. In a further embodiment, the support structure may be shaped to provide increased structural strength to withstand high pressures and vibration. For example, the support structure 310 may include rounded edges and/or convex sides.

The spring housing 212 may extend from an end of the main body 202 of the lubricator 102. In an embodiment, the lubricator 102 may include a spring housing coupler 302, such as a nut or collar for connecting the spring housing 212 to the main body 202. In some embodiments, the spring housing coupler 302 may be integral with the main body 202. For example, the spring housing coupler 302 may be forged together with the main body 202.

Figure 4:
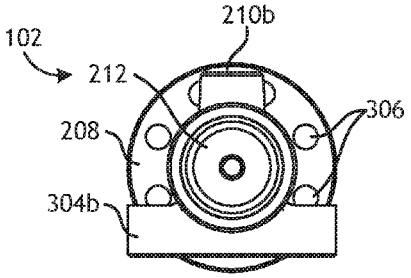
FIG. 4 is a top view diagram illustrating one embodiment of a forged flange lubricator.

FIG. 4 is a top view diagram illustrating one embodiment of a forged flange lubricator 102. The embodiment of FIG. 4 illustrates the flange 304*b*associated with port 204*b*. As illustrated the flange 304*b* may be integral with the main body 202. In an embodiment, the catch port 210*b* may be disposed on a side opposite port 204*b*. In one such embodiment, catch port 210*b* may comprise an opening configured for receiving components of a catch assembly configured to catch the plunger 116 when it is received by the lubricator 102. As shown, in one embodiment, the spring housing 212 may be disposed at a top side of the lubricator 102.

Figure 5:
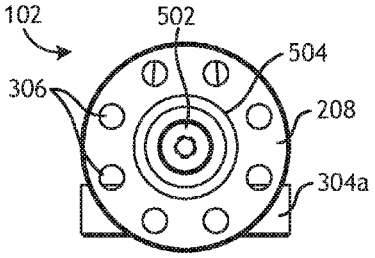
FIG. 5 is a bottom view diagram illustrating one embodiment of a forged flange lubricator.

FIG. 5 a bottom view diagram illustrating one embodiment of a forged flange lubricator 102. FIGS. 4-5 show that the fixation points 306 may extend entirely through the flange 208 at the inlet port 502. For example, the fixation points 306 may include holes through the flange 208 for receiving bolts used to bolt the flange to the wellhead 104. Additionally, the flange 208 may include a sealing member receiver 504, such as a groove or slot for receiving an o-ring or gasket.

Figure 6:
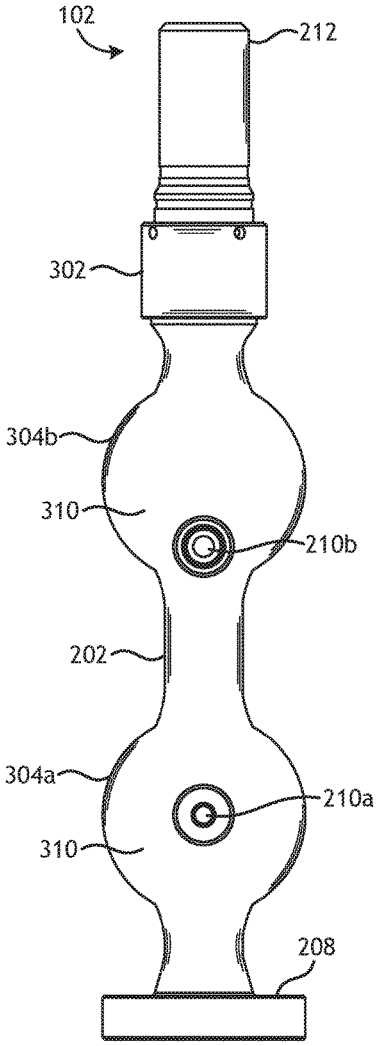
FIG. 6 is a back view diagram illustrating one embodiment of a forged flange lubricator.
Figure 7:
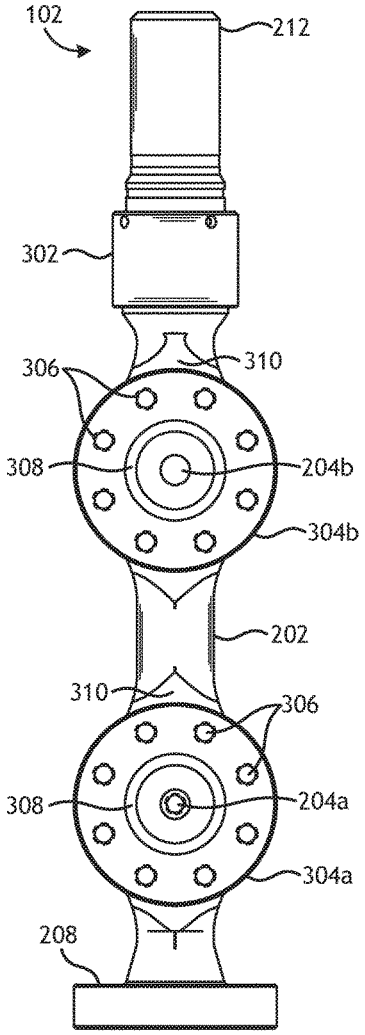
FIG. 7 is a front view diagram illustrating one embodiment of a forged flange lubricator.

FIG. 6 is a back view diagram illustrating one embodiment of a forged flange lubricator 102. As shown in FIG. 6, the support structure 310 may be formed with a curved profile to provide additional strength to the ports 204*a-b*. In an embodiment, the support structure 310 may be shaped to conform to an outer profile of the flanges 304*a-b*. In an embodiment, the fixation points 306 may not pass all the way through the flange 304*b* to the back side. Rather, as shown in FIG. 7, the fixation points 306 may include threaded holes for receiving a bolt, screw, or the like. One of ordinary skill will recognize alternative embodiments. For example, the fixation points 306 may include keyed slots for receiving mating portions of a peripheral component.

Figure 8:
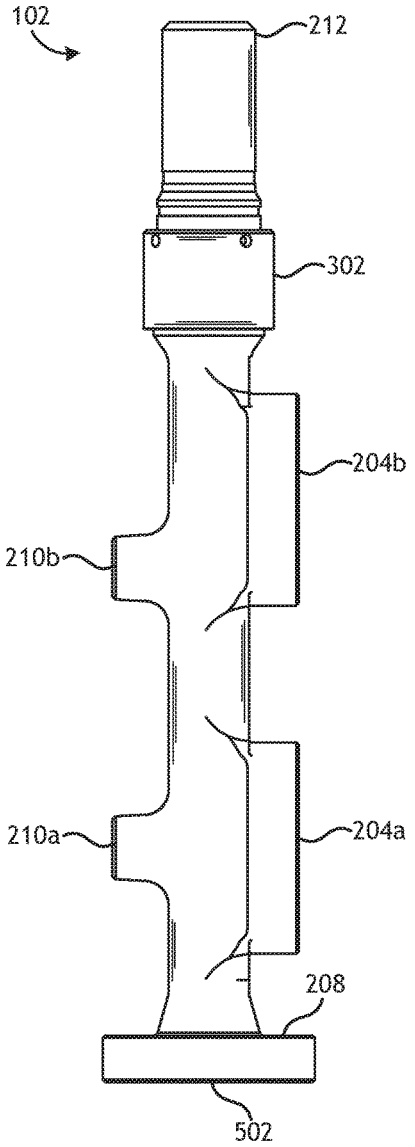
FIG. 8 is a side view diagram illustrating one embodiment of a forged flange lubricator.

FIG. 7 illustrates the sealing member receiver 308 in further detail. Additionally, as shown, a portion of the support structure 310 on the front of the lubricator 102 may be tapered to smoothly transition between the main body 202 and the flanges 304*a-b*. FIG. 8 is a side view diagram illustrating one embodiment of a forged flange lubricator 102.

Figure 9:
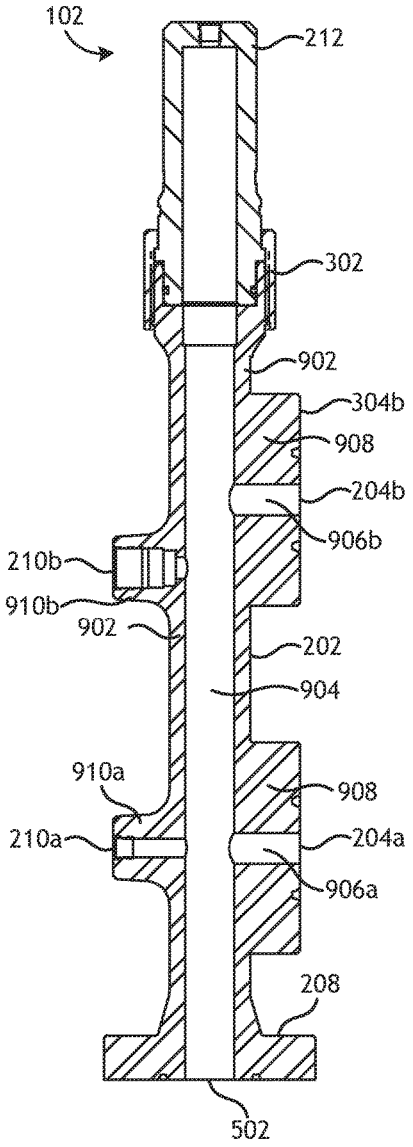
FIG. 9 is a cross-section view diagram illustrating one embodiment of a forged flange lubricator.

FIG. 9 is a cross-section view diagram illustrating one embodiment of a forged flange lubricator 102. In the embodiment of FIG. 9, the ports 204*a-b* may include channels 906*a-b* configured to extend through the flange material 908 to the interior cavity 904 of the main body 202. As shown, the material defining the sidewalls 902 of the main body 202 are unitary with the material defining the body 908 of the flange 304*a-b*. In such an embodiment, the lubricator 102 may be formed by a forging process. In one embodiment, the ports 204*a-b*, 210*a*, and 210*b* may be formed during the forging process. In an alternative embodiment, the ports 204*a-b*, 210*a*, 210*b* may be formed in a secondary machining or drilling process, but in all embodiments, the main body 202 and the ports 204*a-b* are defined by a unitary body that is free from welds and other junctions.

One of ordinary skill will recognize that in various embodiments, certain peripheral or secondary components, such as the spring housing 212, sensors (not shown), the catch mechanism (not shown), and the like, may be welded or otherwise affixed to the main body 202, but the body defining the sidewalls 902 and the flanges 908 is a unitary body devoid of welds or other applied junctions between the main body 202 and the ports 204*a-b*, 210*a*, and 210*b*.

Figure 10:
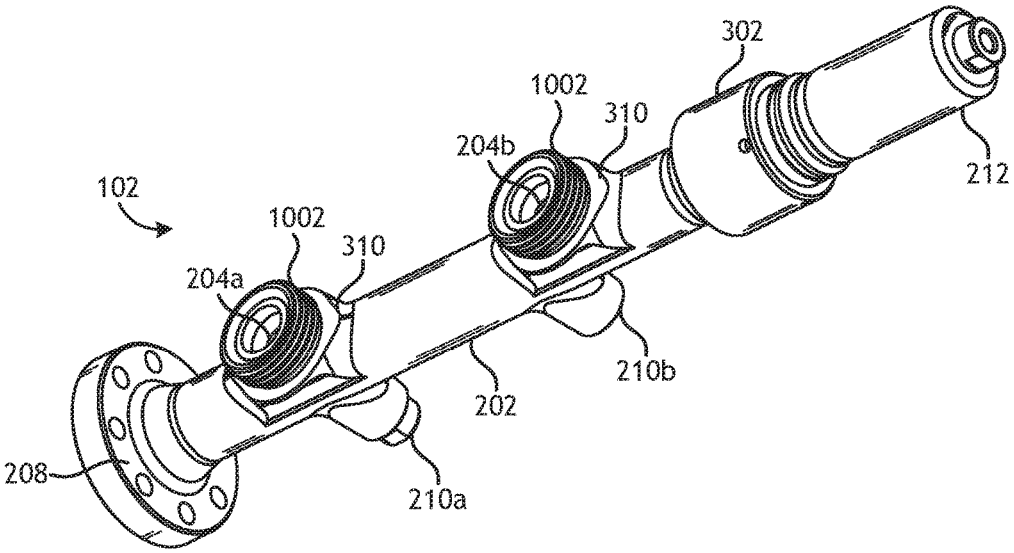
FIG. 10 is a perspective view diagram illustrating one embodiment of a forged flange lubricator.
Figure 11:
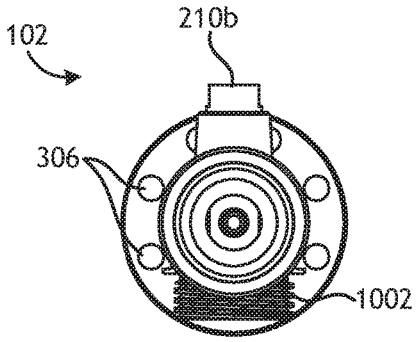
FIG. 11 is a top view diagram illustrating one embodiment of a forged flange lubricator.
Figure 12:
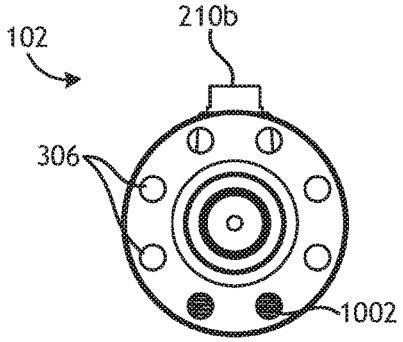
FIG. 12 is a bottom view diagram illustrating one embodiment of a forged flange lubricator.

FIG. 10 is a perspective view diagram illustrating one embodiment of a forged flange lubricator 102. In the embodiment of FIGS. 10-16, the area defining the ports 204*a-b* includes threads 1002 for receiving a peripheral component with a mating threaded coupler. FIG. 11 is a top view diagram illustrating one embodiment of the forged flange lubricator 102 and FIG. 12 is a bottom view diagram illustrating one embodiment of the forged flange lubricator 102. As shown in FIG. 12, the inlet flange 208 may be similar in configuration to the inlet flange 208 of FIGS. 3-9. For example, the inlet flange 208 may include one or more fixation points 306. In the embodiment of FIG. 11, the profile of the port threads 1002 is illustrated. In various embodiments, the diameter of the catch port 210*b*, and the thread types or sizes may vary depending upon the details of the catch assembly.

Figure 13:
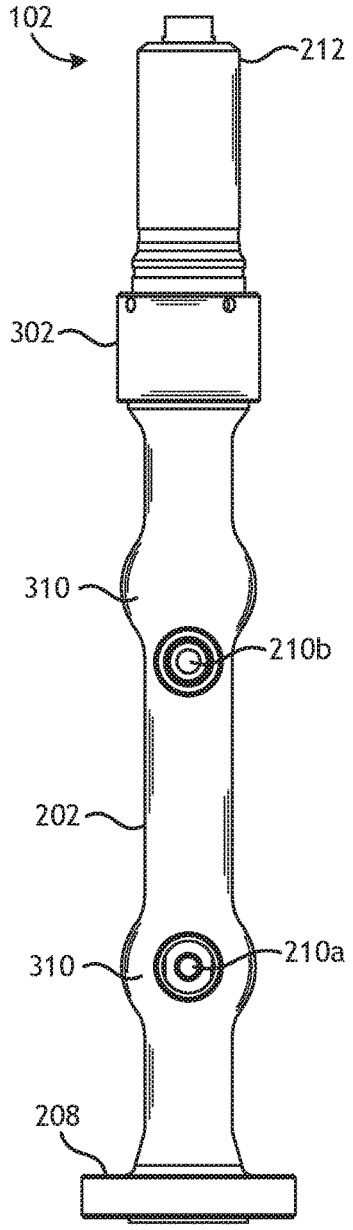
FIG. 13 is a back view diagram illustrating one embodiment of a forged flange lubricator.
Figure 14:
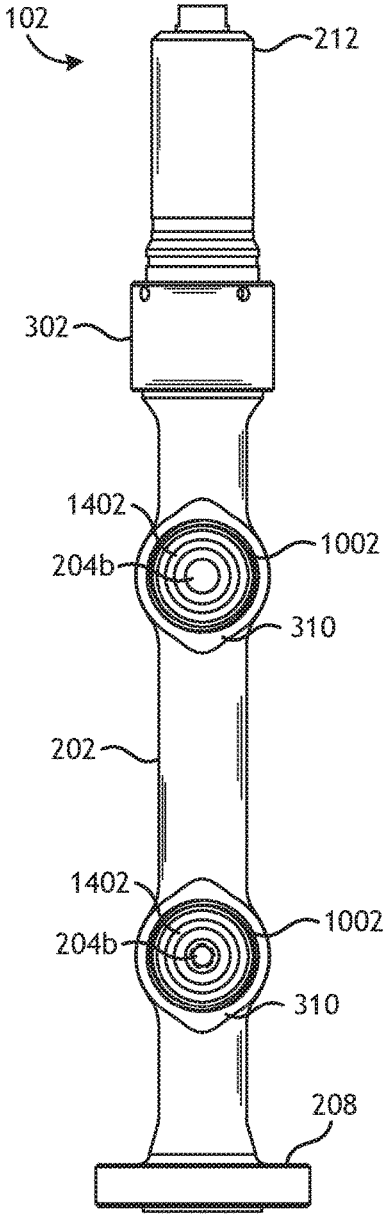
FIG. 14 is a front view diagram illustrating one embodiment of a forged flange lubricator.

FIG. 13 is a back view diagram illustrating one embodiment of the forged flange lubricator 102. In the embodiment, the back profile of the support structure 310 may be smaller than the profile of the embodiment in FIGS. 3-9, because the size of the port coupler is smaller than the flange 304*a-b*. FIG. 14 is a front view diagram illustrating one embodiment of the forged flange lubricator 102. In an embodiment, the lubricator 102 includes a sealing member receiver 1402 configured to receive a sealing member, such as an O-ring or gasket for forming a seal between the port 204*a,b* and the peripheral component.

Figure 15:
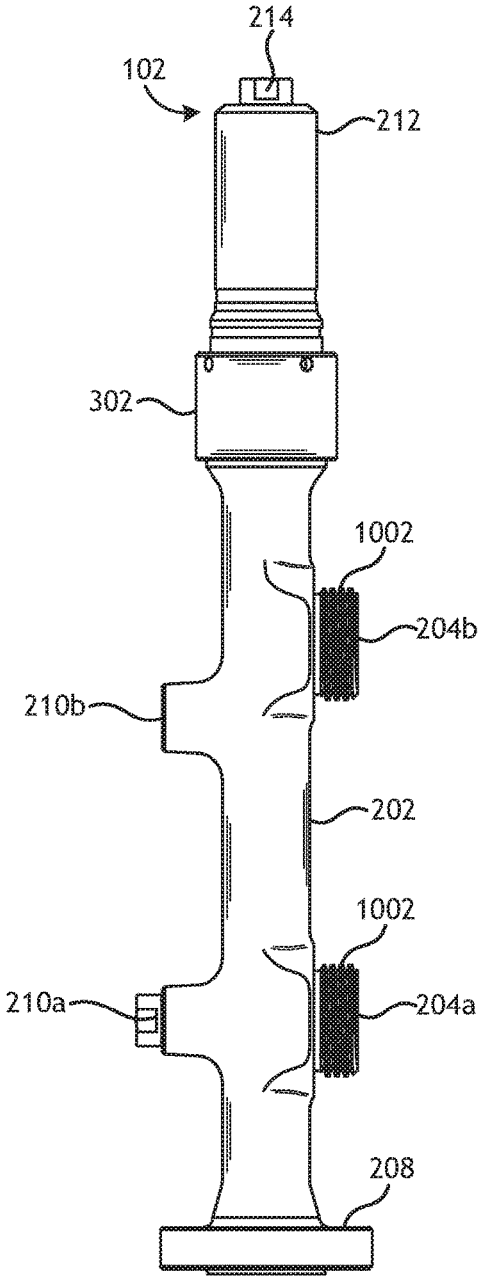
FIG. 15 is a side view diagram illustrating one embodiment of a forged flange lubricator.
Figure 16:
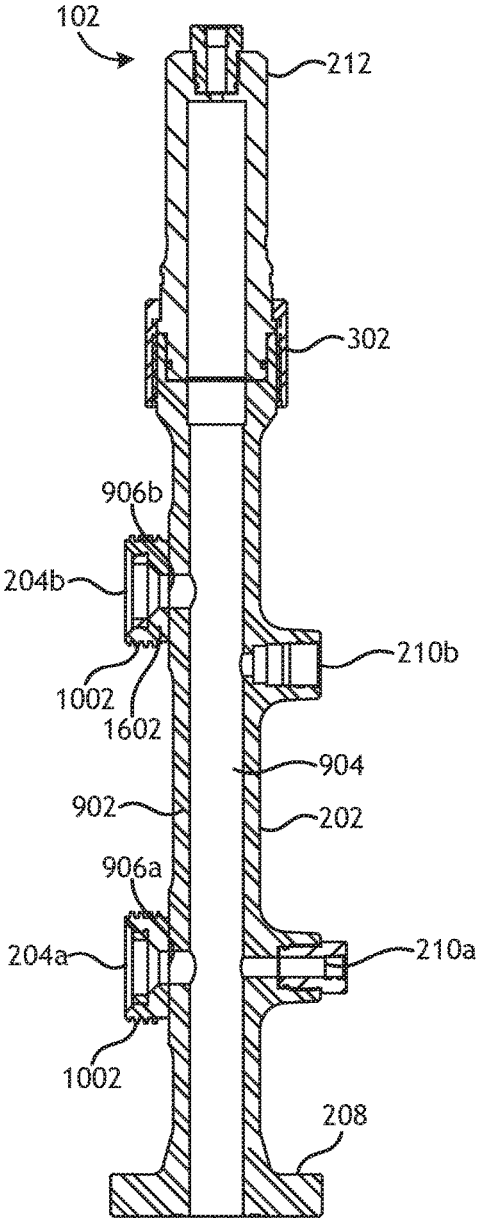
FIG. 16 is a cross-section view diagram illustrating one embodiment of a forged flange lubricator.

FIG. 15 is a side view diagram illustrating one embodiment of the forged flange lubricator 102, and FIG. 16 is a cross-section view diagram illustrating one embodiment of the forged flange lubricator 102. The cross-section shows that the region 1602 forming the structural support 310 and the material forming the sidewalls 902 of the main body 202 are a unitary structure devoid of any applied junctions. Similarly, the channels 906*a-b* directly connect the ports 204*a-b* to the main channel 904 of the main body 202. In the embodiment of FIG. 15, the additional sensor port 214 may be included with the spring housing 212 to sense when the plunger 116 has been received by the spring/catch assembly 214.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An apparatus, comprising:

a main body configured to receive fluid from a well;

a first non-threaded flange on the main body including one or more fixation points;

a second non-threaded flange on the main body including one or more fixation points;

a first port in the main body associated with the first non-threaded flange for receiving fluid from a well;

a second port in the main body associated with the second non-threaded flange for conducting fluid into or out of the main body; and a third port in the main body;

wherein the main body, the first non-threaded flange, and the second non-threaded flange are a unitary structure devoid of applied junctions.

2. The apparatus of claim 1, wherein at least one of the first or second non-threaded flanges is configured to receive a fastener at the one or more fixation points for fastening a peripheral component to the flange.

3. The apparatus of claim 2, wherein at least one of the first or second non-threaded flanges further comprises a groove for receiving a sealing member, the sealing member configured to form a seal between the flange and the peripheral component.

4. The apparatus of claim 1, wherein the first non-threaded flange is configured to interface with a wellhead.

5. The apparatus of claim 1, further comprising a support structure disposed around the first port and the second port for strengthening a region of the main body surrounding the port.

6. The apparatus of claim 1, further comprising a third non-threaded flange on the main body, wherein the third non-threaded flange and the main body form a unitary structure devoid of applied junctions.

7. The apparatus of claim 1, wherein the third port further comprises a sensor port configured to receive a sensor device.

8. The apparatus of claim 7, further comprising a plurality of sensor ports, each sensor port and the main body forming a unitary structure devoid of applied junctions.

9. The apparatus of claim 1, further comprising a plunger catcher assembly configured to catch and release a plunger as it is received by the main body.

10. The apparatus of claim 9, wherein the plunger catcher assembly further comprises a spring.

11. The apparatus of claim 10, wherein the spring is a progressive rate spring assembly.

12. The apparatus of claim 9, wherein the plunger catcher assembly is housed, at least in part, in a removable extension coupled to the main body.

13. A system, comprising:

a well assembly comprising a well bottom, a wellhead, and a well pipe coupling the wellhead to the well bottom;

a plunger lift assembly configured to lift fluid from the well bottom to the wellhead;

a bumper assembly disposed proximate to the well bottom and configured to catch the plunger lift assembly before reaching the well bottom; and a lubricator disposed proximate to the wellhead, the lubricator comprising:

a main body configured to receive fluid raised by the plunger lift assembly from the well assembly;

a first non-threaded flange on the main body including one or more fixation points;

a second non-threaded flange on the main body including one or more fixation points;

a first port in the main body associated with the first non-threaded flange for receiving fluid from a well;

a second port in the main body associated with the second non-threaded flange for conducting fluid into or out of the main body; and a third port in the main body;

wherein the main body, the first non-threaded flange, and the second non-threaded flange are a unitary structure devoid of applied junctions.

14. The system of claim 13, wherein the first or second non-threaded flanges is configured for receiving a mating flange of a peripheral component to interface with the lubricator.

15. The system of claim 13, wherein the first non-threaded flange is configured to interface with a wellhead.

16. The system of claim 13 further comprising a third non-threaded flange on the main body, wherein the third non-threaded flange and the main body form a unitary structure devoid of applied junctions.

* * * * *